United States Patent [19]

Shoenfeld

[11] Patent Number: 4,570,416

[45] Date of Patent: Feb. 18, 1986

[54] OVERNIGHT PACKAGE

[75] Inventor: David B. Shoenfeld, Cordova, Tenn.

[73] Assignee: Federal Express Corporation, Memphis, Tenn.

[21] Appl. No.: 538,121

[22] Filed: Oct. 3, 1983

[51] Int. Cl.[4] ..... B65B 61/00

[52] U.S. Cl. ..... 53/415; 229/71; 283/79

[58] Field of Search ..... 229/71, 74; 53/415, 53/266 A, 469

[56] References Cited

U.S. PATENT DOCUMENTS

| | | | |
|---|---|---|---|
| 1,052,865 | 2/1913 | Ward | 283/79 X |
| 1,247,628 | 11/1917 | Britton | 283/79 X |
| 1,261,514 | 4/1918 | Greenstein | 283/79 |
| 2,345,342 | 3/1944 | Kahn | 229/71 X |
| 3,370,365 | 2/1968 | Vosbikian | 229/71 X |
| 3,987,960 | 10/1976 | Gardiner | 283/79 X |
| 4,407,524 | 10/1983 | Trautlein | 283/79 X |

*Primary Examiner*—Paul A. Bell

*Attorney, Agent, or Firm*—Wood, Herron & Evans

[57] ABSTRACT

An overnight package for delivery of letters. The package consists of a ply of paperboard and a ply of film joined to the paperboard to create a pouch in which an envelope bearing the shipper's address and the recipient's address may be inserted. The pouch has a pressure-sensitive sealing flap to securely enclose the letter within the pouch, thereby forming the shipping package.

2 Claims, 4 Drawing Figures

FIG. 1
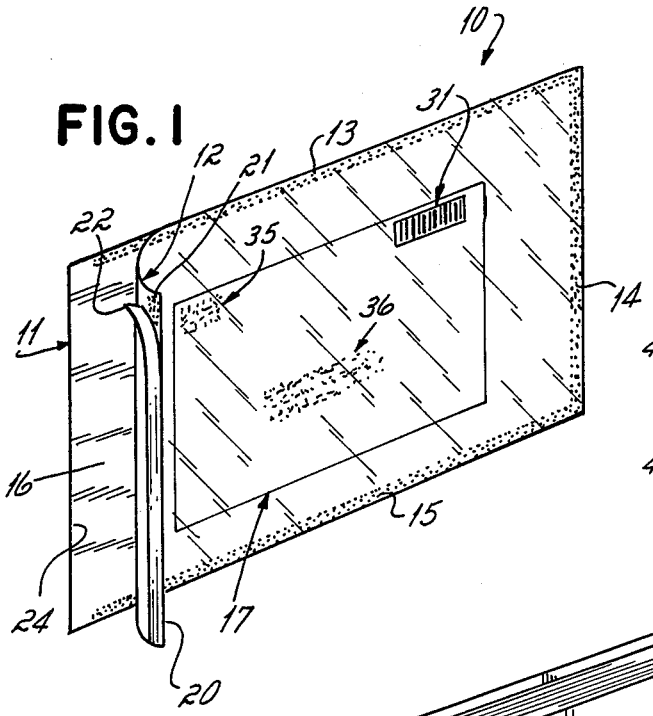
FIG. 3
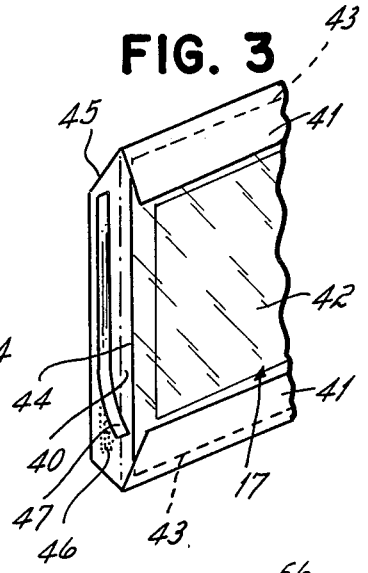
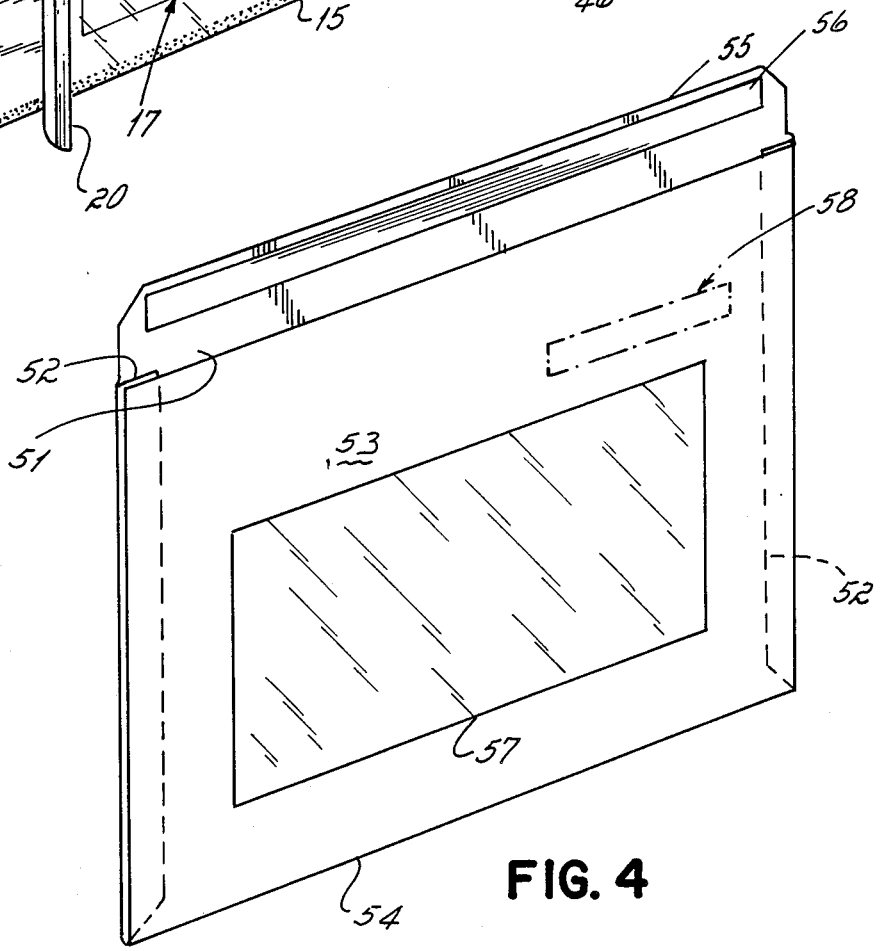
FIG. 4

OVERNIGHT PACKAGE

This invention relates to a package and a method of handling overnight delivery of letters.

Federal Express Corporation has an overnight letter service for which it provides to its customers a two-part package. The first part consists of two plies of paperboard in which a letter can be inserted. A sealing flap enables the letter to be sealed between the two plies. On one side of the paperboard package, provision is made for applying a label which contains the address of the shipper as well as the recipient. The other side consists of a single ply of plastic film sealed around three edges to form a pouch. The pouch is to receive an airbill which contains the name and address of the shipper and recipient. The airbill also has an airbill number in Arabic numerals as well as on a machine-readable code bar. The airbill number is read at the shipper's terminal and at the recipient's terminal with the information being fed into a computer, thereby enabling the company to keep track of the movement of the latter.

Recently, Federal Express introduced an express manifest to replace the airbill for those shippers who regularly ship multiple packages. The express manifest is a single document with one place to list the shipper's name and address and with multiple positions, e.g., eight, for listing the various recipients. Associated with each recipient is a tracking number in Arabic numerals as well as on a machine-readable code bar. The tracking number is also duplicated on a label which can be stripped from the express manifest document and placed by pressure-sensitive adhesive on the shipper's package.

The express manifest significantly simplifies the clerical steps required to send multiple packages.

An objective of the present invention has been to provide further improvements in the handling on the part of the shipper and to simplify the overnight letter package.

This objective is attained by providing a two-ply package consisting of a single ply of paperboard and a single ply which is primarily transparent film which, with the paperboard, forms a pouch. A sealing flap is provided to seal the pouch.

This package, in cooperation with the express manifest, admits of the following simplified method.

The shipper inserts a letter into the shipper's normal envelope, for example, a number 10 envelope which conventionally will have the shipper's address in the upper left-hand corner and the recipient's address typed on the face of the envelope. An entry in the manifest is made and the bar code label is placed on the shipper's envelope or on the package. The shipper's envelope is placed in the package and sealed. Thus, the package is ready for delivery to the carrier.

The invention provides the advantages in that the handling eliminates the need for the preparation of a separate label with the shipper's and recipient's address and the pasting of that label to the package. This is particularly advantageous in a mailroom where many overnight letters are sent out every day. The invention provides the further advantage that the weight of the package is significantly reduced by the elimination of one of the two plies of paperboard.

The several features and advantages of the invention will become more readily apparent from the following detailed description taken in conjunction with the accompanying drawings in which:

FIG. 1 is a perspective view showing the invention;

FIG. 3 is a fragmentary perspective view showing an alternative embodiments; and FIG. 4 is a perspective view showing still another embodiment.

Figure 2:
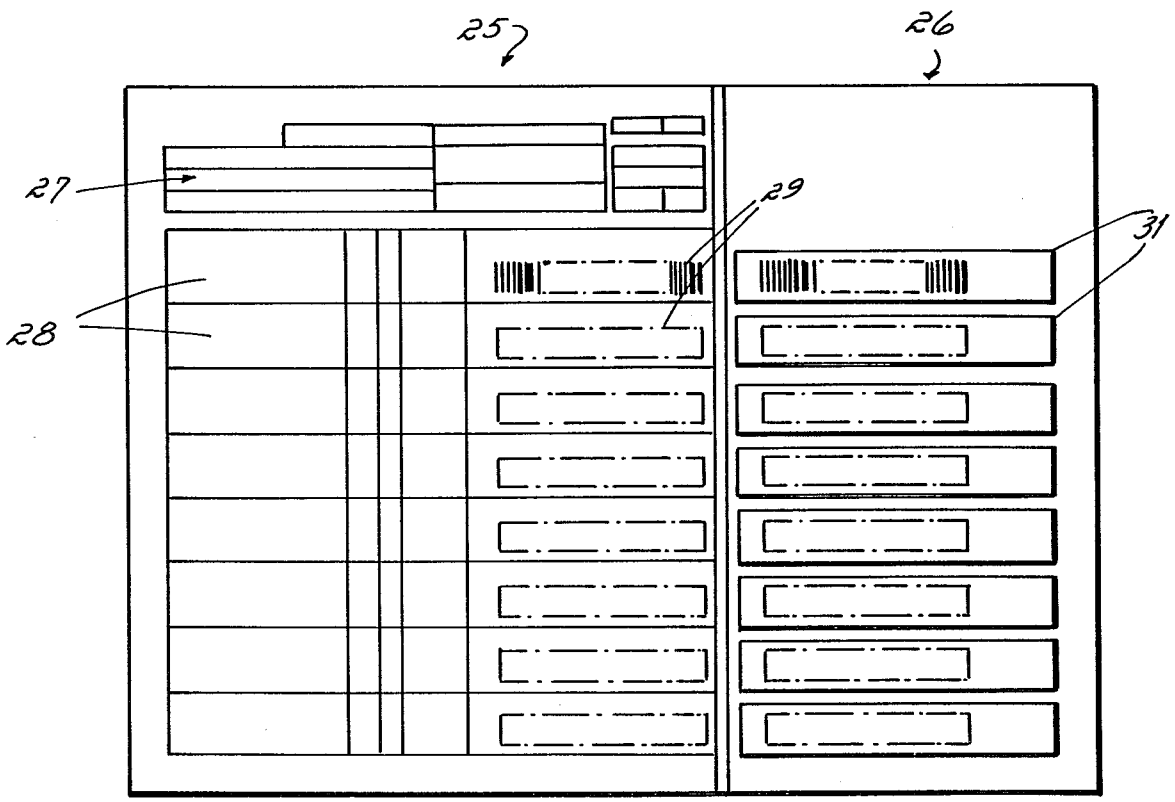
FIG. 2 is a plan view showing the manifest.

Referring to FIG. 1, the package is indicated at 10 and consists of a stiff paperboard backing 11 and a film 12 which is sealed around three edges of the backing 11 as at 13, 14, and 15. The film and backing provide a pouch open at the end 16 into which an envelope 17 can be inserted. The film has a free end 20 containing a pressure-sensitive adhesive 21 covered by a sealable strip 22. When the strip 22 is removed, the free end 20 can be applied to the open edge 24 of the stiff backing 11 to seal the envelope 17 within the pouch.

The mainfest with which the present invention is used is known and has been in public use. As seen in FIG. 2, it consists of two panels 25 and 26. The first panel 25 has three carbonless identical sheets providing a "tracing copy," a "shipper's copy," and a "billing copy." Each sheet contains a heading 27 providing the name and other particulars of the shipper. Below the heading 27 are eight blocks 28 which contain the name and address of the recipient as well as a package tracking number indicated at 29, the tracking number being in Arabic as well as a machine-readable bar code.

The opposing panel 26 has eight labels having the bar code and Arabic tracking number on one side as indicated at 31 and a pressure-sensitive adhesive on the other side. The labels are temporarily mounted on the panel 26 and are adapted to be removed and placed on the overnight letter.

In the operation of the invention, the shipper prepares a letter, addresses an envelope and inserts the letter in the envelope, all as is highly conventional in business practice. That envelope contains the address of the shipper in the upper left-hand corner indicated at 35 and contains the address of the recipient in the central portion as indicated at 36. The pressure-sensitive label 31 is taken from the manifest and preferably is applied to the package 10 but can be applied to the upper right-hand corner of the envelope. That label contains in machine-readable form the bar code of the particular package being shipped. The envelope thus prepared is inserted into the package and the free end is closed by pressing the pressure-sensitive adhesive 21 on the free end 20 against the edge 24 of the backing 11. The shipper delivers the manifest and all of the packages prepared in accordance with FIG. 1 in the foregoing description to the express company. The label with the bar code is machine read at the various terminals as is conventional practice in order to follow the path of the package until it arrives at the recipient's address. In the event the package is lost, it can be traced. The shipper refers to the manifest, ascertains its bar code, determines from the computer how far the package moved and traces it from that point. Thus, the current practice of package tracing can be effected with the current pressure-sensitive bar code obtained from the manifest in accordance with current practices. However, the sending of overnight letters is simplified for the shipper in the elimination of the steps of typing and pasting a label on the package and there is significant weight reduction which benefits the carrier by virtue of the reduced weight of the package through the elimination of one of the paperboard plies conventionally used prior to the invention.

An alternative form of the invention is shown in FIG. 3. As shown in FIG. 3, a backing 40 has flaps 41 around its periphery. A ply of thin film 42 has marginal edges 43 underlying the flaps 41. Those edges are glued to the flap on one side and to the backing on the other to form a pouch. The pouch is open at the end 44. The backing has a sealing flap 45 to which a pressure-sensitive adhesive 46 is applied, the adhesive being covered by a peelable strip 47. When an envelope 17 is prepared as described above and inserted into the package, it can be sealed in the package by removing the strip and folding the sealing strip over upon the free edge of the film 42. In operation, the use of the package of FIG. 3 is the same as that of FIG. 1.

It should also be understood that a package could be prepared by initially sealing the short sides and one long side so that the package is open at the top rather than at the left-hand edge as depicted in the illustrated form of the invention.

Such a package is shown in FIG. 4 This package has a paperboard backing 51 having sealing flaps 52 along its vertical edges. A front ply 53 is hinged to the back ply along a crease 54 and is sealed along its edges to the sealing flaps 52 to form a pouch. A free sealing flap 55 is secured to the backing 51 along its upper edge. Pressure-sensitive adhesive is covered by a peelable strip 56, the pressure-sensitive adhesive enabling the sealing flap to be closed on top of the front ply 53.

The package of FIG. 4 is preferably $9\frac{1}{2}'' \times 12\frac{1}{2}''$ and contains a window 57 which is $6'' \times 9''$. This package can be used as a standard package to carry regular No. 10 business envelopes as well as envelopes suitable for mailing $8\frac{1}{2}'' \times 11''$ documents without folding. As in the previous embodiments, the envelope to be inserted is addressed and inserted so that the shipper's and recipient's addresses are clearly visible through the window. The pressure-sensitive bar code label from the manifest is applied in the area indicated at 58. After sealing, the envelope is ready to go to the carrier with the manifest. While the envelope of FIG. 4 does not have the complete weight-saving features of the previous embodiments, a reduction in the weight of about 45% over a comparable overnight letter package suitable for receiving $8\frac{1}{2}'' \times 11''$ documents is achieved.

Having described my invention, I claim:

1. The method of handling express envelopes in a two ply package formed of a backing member and a front ply, a substantial portion of which is a transparent film, entering the recipient's name on a manifest having a pressure-sensitive tracer label mounted on it;

addressing with the recipient's name and address an envelope having a shipper's address thereon;

securing said tracer label to said envelope or package;

and inserting said envelope in said package with said address and label visible through said film.

2. The method of handling express envelopes in a two ply package formed of a backing member and a front ply, a substantial portion of which is formed of transparent film;

addressing with the recipient's name and address an envelope having the shipper's address thereon;

adhesively securing a strip having a tracer bar code thereon onto said envelope or package;

inserting said envelope into said package; and delivering said envelope to the shipping company.

* * * * *